US009551346B2

(12) United States Patent
Kitamura et al.

(10) Patent No.: US 9,551,346 B2
(45) Date of Patent: Jan. 24, 2017

(54) SERIAL AXIAL FAN

(71) Applicant: Nidec Corporation, Kyoto (JP)

(72) Inventors: Jumpei Kitamura, Kyoto (JP); Hidenobu Takeshita, Kyoto (JP); Tomotsugu Sugiyama, Kyoto (JP)

(73) Assignee: Nidec Corporation, Kyoto (JP)

( * ) Notice: Subject to any disclaimer, the term of this patent is extended or adjusted under 35 U.S.C. 154(b) by 411 days.

(21) Appl. No.: 14/250,750

(22) Filed: Apr. 11, 2014

(65) Prior Publication Data

US 2014/0363272 A1 Dec. 11, 2014

(30) Foreign Application Priority Data

Jun. 7, 2013 (JP) ..... 2013-121198

(51) Int. Cl.
*F01D 1/24* (2006.01)
*F04D 19/00* (2006.01)
*F04D 29/38* (2006.01)

(52) U.S. Cl.
CPC ..... *F04D 19/007* (2013.01); *F04D 29/384* (2013.01)

(58) Field of Classification Search
CPC ..... F04D 19/007; F04D 29/384
See application file for complete search history.

(56) References Cited

U.S. PATENT DOCUMENTS

2005/0106026 A1* 5/2005 Oosawa ..... F04D 19/007 416/198 R
2007/0059155 A1 3/2007 Ishihara et al.
2008/0031723 A1* 2/2008 Yoshida ..... F04D 19/007 415/68
2009/0047118 A1 2/2009 Ishihara et al.
2009/0148311 A1* 6/2009 Yoshida ..... F04D 19/007 417/244
2009/0226299 A1* 9/2009 Jin ..... F04D 19/007 415/66
2011/0044799 A1* 2/2011 Takemoto ..... F04D 19/007 415/143
2011/0052433 A1* 3/2011 Huang ..... F04D 19/007 417/423.5

(Continued)

FOREIGN PATENT DOCUMENTS

JP 2002-021777 A 1/2002
JP 2004-278370 A 10/2004

(Continued)

*Primary Examiner* — Jesse Bogue
(74) *Attorney, Agent, or Firm* — Keating & Bennett, LLP

(57) ABSTRACT

A fan includes a first motor portion, a first impeller fixed to a first rotating portion of the first motor portion, a second motor portion arranged along a central axis of the first motor portion, a second impeller fixed to a second rotating portion of the second motor portion, a tubular wind channel portion arranged to surround the first and second impellers, and support ribs arranged to join the wind channel portion to the first and second motor portions. The first impeller includes first blades arranged in a circumferential direction about the central axis and the second impeller includes second blades arranged in the circumferential direction, a rotation direction of the second impeller is opposite to a rotation direction of the first impeller. A surface of each first blade which faces the second impeller is concave. A surface of each second blade which faces the first impeller is concave.

9 Claims, 8 Drawing Sheets

(56) References Cited

U.S. PATENT DOCUMENTS

| | | | | |
|---|---|---|---|---|
| 2012/0257957 | A1* | 10/2012 | Yanagisawa | F04D 19/007 415/61 |
| 2013/0045109 | A1* | 2/2013 | Lee | F04D 19/007 416/244 R |
| 2014/0363272 | A1 | 12/2014 | Kitamura et al. | |

FOREIGN PATENT DOCUMENTS

| | | | |
|---|---|---|---|
| JP | 2009-250225 | A | 10/2009 |
| JP | 2010-185443 | A | 8/2010 |

* cited by examiner

SERIAL AXIAL FAN

BACKGROUND OF THE INVENTION

1. Field of the Invention

The present invention relates to a serial axial fan, and more specifically to a serial axial fan including two impellers arranged in series.

2. Description of the Related Art

Blower fans are widely used to cool household electrical appliances, office equipment, industrial equipment, and so on, for air conditioning or ventilation, or as blowers for use in vehicles and so on. As such a blower fan, a serial axial fan including two axial fans connected in series along a central axis is known. For example, a counter-rotating axial blower is disclosed in JP-A 2004-278370. In this blower, a first impeller and a second impeller are arranged in series along a central axis inside a housing. The first and second impellers are arranged to rotate in mutually opposite directions.

JP-A 2002-21777 discloses a jet fan installed on a ceiling of a tunnel. The jet fan includes a first impeller, a second impeller, and reverse rotation means arranged to cause the first and second impellers to rotate in mutually opposite directions. Each of the first and second impellers is arranged to be reversible in rotation. JP-A 2009-250225 discloses an axial blower. The axial blower includes two impellers arranged in series, and is arranged to be capable of rotating in both a normal direction and a reverse direction. Each of rotor blades of each impeller has a curved cross-section.

The serial axial fan is typically arranged to send air in a fixed direction as is the case with the counter-rotating axial blower disclosed in JP-A 2004-278370. Therefore, each blade is arranged to have a shape appropriate for sending air in the single fixed direction. In the counter-rotating axial blower disclosed in JP-A 2004-278370, for example, each of front and rear blades has a curved shape with a concave portion thereof being open toward an outlet side.

Meanwhile, depending on a purpose of the blower fan, the blower fan is demanded to be capable of sending air in both directions equivalently, and an increase in static pressure is demanded for each of the case where the blower fan sends air in one direction and the case where the blower fan sends air in an opposite direction. In the case where blower fans having the same design are installed on a variety of devices, for example, it is desirable that the blower fans should be capable of sending air in both directions. However, a blower fan designed to send air in a single fixed direction suffers a significant decrease in a static pressure characteristic when sending air in an opposite direction.

The jet fan disclosed in JP-A 2002-21777 is capable of sending air in both directions. Each blade of the jet fan is in the shape of a flat plate, and therefore, high static pressure cannot be obtained. The axial blower disclosed in JP-A 2009-250225 is also capable of sending air in both directions. However, because the two impellers are arranged to rotate in the same direction when viewed along a central axis, an outgoing air current has a large whirl component and spreads radially. Therefore, high static pressure cannot be obtained.

SUMMARY OF THE INVENTION

Preferred embodiments of the present invention are configured to easily obtain high static pressure both in the case where a serial axial fan sends a fluid in one direction and in the case where the serial axial fan sends a fluid in an opposite direction.

A serial axial fan according to a preferred embodiment of the present invention includes a first motor portion including a first rotating portion; a first impeller fixed to the first rotating portion of the first motor portion; a second motor portion arranged along a central axis of the first motor portion, and including a second rotating portion; a second impeller fixed to the second rotating portion of the second motor portion; a tubular wind channel portion arranged to surround outer circumferences of the first and second impellers; and a plurality of support ribs arranged to join the wind channel portion to both the first and second motor portions. The first impeller includes a plurality of first blades arranged in a circumferential direction about the central axis, while the second impeller includes a plurality of second blades arranged in the circumferential direction. Each of the first and second impellers is configured to be rotatable in both directions, and a rotation direction of the second impeller is opposite to a rotation direction of the first impeller. A surface of each of the plurality of first blades, the surface facing the second impeller, is concave. A surface of each of the plurality of second blades, the surface facing the first impeller, is concave.

Preferred embodiments of the present invention make it easy to obtain high static pressure both in the case where the serial axial fan sends a fluid in one direction and in the case where the serial axial fan sends a fluid in an opposite direction.

The above and other elements, features, steps, characteristics and advantages of the present invention will become more apparent from the following detailed description of the preferred embodiments with reference to the attached drawings.

DETAILED DESCRIPTION OF THE PREFERRED EMBODIMENTS

Figure 1:
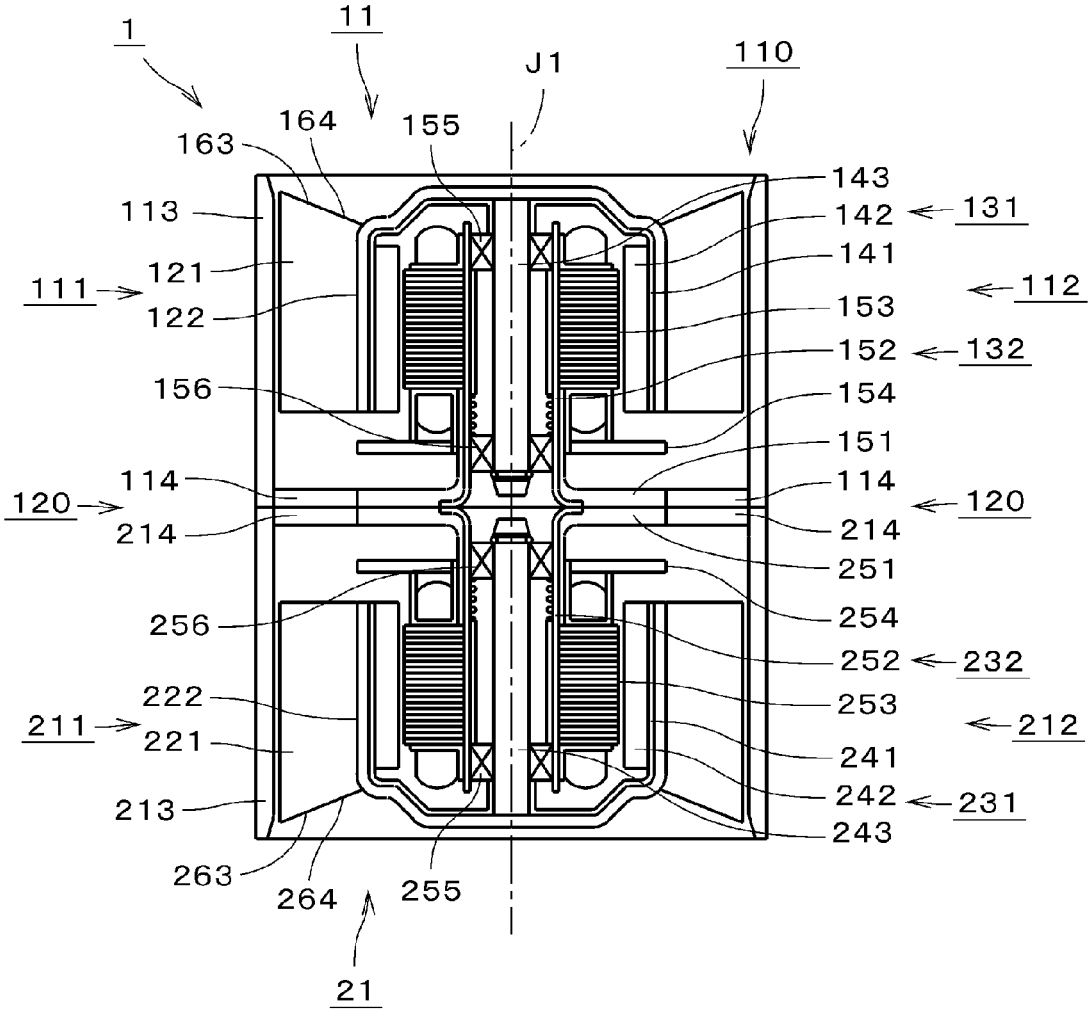
FIG. 1 is a vertical cross-sectional view of a serial axial fan according to a preferred embodiment of the present invention.

It is assumed herein that an upper side and a lower side in a direction parallel or substantially parallel to a central axis J1 of a serial axial fan 1 in FIG. 1 are referred to simply as an upper side and a lower side, respectively. It should be noted, however, that the above definitions of a vertical direction and the upper and lower sides should not be construed to restrict relative positions or directions of different members or portions when the serial axial fan 1 is actually installed on a device. Also note that the direction parallel or substantially parallel to the central axis J1 is referred to by the term "axial direction", "axial", or "axially", that radial directions centered on the central axis J1 are simply referred to by the term "radial direction", "radial", or "radially", and that a circumferential direction about the central axis J1 is simply referred to by the term "circumferential direction", "circumferential", or "circumferentially".

FIG. 1 is a vertical cross-sectional view of the serial axial fan 1 according to a preferred embodiment of the present invention. The serial axial fan 1 is preferably used, for example, as a cooling fan arranged to air-cool an electronic device, such as a server or a router. The serial axial fan 1 includes a first axial fan 11 and a second axial fan 21. The first axial fan 11 is arranged on an upper side in FIG. 1. The second axial fan 21 is arranged on a lower side of the first axial fan 11, and is joined to the first axial fan 11 along the central axis J1. The central axis J1 coincides with a central axis of each of the first and second axial fans 11 and 21.

The serial axial fan 1 is configured to be capable of sending air both upward and downward. That is, the serial axial fan 1 is arranged to be capable both of taking in air from the upper side in FIG. 1 and sending out the air downward, and of taking in air from the lower side in FIG. 1 and sending out the air upward.

The first axial fan 11 preferably includes a first impeller 111, a first motor portion 112, a first housing 113, and a plurality of first rib components 114. The first motor portion 112 is arranged to rotate the first impeller 111 about the central axis J1 to generate air current. The first housing 113 is preferably tubular and arranged to surround an outer circumference of the first impeller 111. The first rib components 114 are preferably arranged on a lower side of the first impeller 111. The first rib components 114 are arranged to support the first motor portion 112.

The first impeller 111 includes a plurality of first blades 121 and a cup 122. The cup 122 preferably has a shape of a covered cylinder or substantially a covered cylinder, and is arranged to cover an outside of the first motor portion 112. The first blades 121 are arranged to extend radially outward from an outside surface of the cup 122, and are arranged in a circumferential direction. The first blades 121 may be arranged either at regular intervals or at irregular intervals. The first motor portion 112 includes a first rotating portion 131, which is a rotating body, and a first stationary portion 132, which is a stationary body. The first rotating portion 131 is arranged on an upper side of the first stationary portion 132.

In FIG. 1, for convenience of illustration, the shape of the first blades 121 of the first impeller 111 is roughly shown on either side of the central axis J1. The first motor portion 112 is shown in exaggerated size. Hatching that should be applied to a section of each component is omitted. The second axial fan 21 is also shown in a similar manner.

The first rotating portion 131 preferably includes a metallic yoke 141, which preferably has a shape of a covered cylinder or substantially a covered cylinder, a cylindrical or substantially cylindrical rotor magnet 142, and a shaft 143. The rotor magnet 142 is fixed to an inside of the yoke 141. The shaft 143 is arranged to project downward from a center of a top portion of the yoke 141. The first impeller 111 is fixed to the first rotating portion 131 such that the cup 122 covers the yoke 141.

The first stationary portion 132 preferably includes a disk-shaped or substantially disk-shaped base portion 151, a bearing holding portion 152, a stator 153, and a circuit board 154. The bearing holding portion 152 is cylindrical or substantially cylindrical, and is arranged to project upward from a center of the base portion 151. The stator 153 is fitted to an outer circumference of the bearing holding portion 152. The circuit board 154 is arranged on a lower side of the stator 153, and is electrically connected to the stator 153.

The first housing 113, the base portion 151, and the first rib components 114 are preferably defined as one monolithic piece by a resin injection molding process, for example. This results in a reduction in production costs of parts. The first housing 113 and the base portion 151 are joined to each other through the first rib components 114.

The stator 153 is arranged radially opposite the rotor magnet 142. A torque centered on the central axis J1 is produced between the stator 153 and the rotor magnet 142. Ball bearings 155 and 156, each of which is a bearing mechanism, are arranged inside an upper portion and a lower portion, respectively, of the bearing holding portion 152. The shaft 143 is inserted in the bearing holding portion 152, and is rotatably supported by the ball bearings 155 and 156.

The second axial fan 21 is preferably arranged to have the same structure as that of the first axial fan 11 turned upside down except in the shape of a portion thereof. The second axial fan 21 preferably includes a second impeller 211, a second motor portion 212, a second housing 213, and a plurality of second rib components 214. The second motor portion 212 is arranged to rotate the second impeller 211 to generate air current traveling in the same direction as that of the air current generated by the first impeller 111. A rotation direction of the first impeller 111 and a rotation direction of the second impeller 211 are opposite to each other when viewed in one direction along the central axis J1. Each of the first and second impellers 111 and 211 is rotatable in both directions.

The first and second motor portions 112 and 212 are arranged along the central axis J1. The central axis J1 coincides with both a central axis of the first motor portion 112 and a central axis of the second motor portion 212. In other words, the second motor portion 212 is arranged along the central axis of the first motor portion 112.

The second housing 213 is tubular and arranged to surround an outer circumference of the second impeller 211. The second rib components 214 are arranged on an upper side of the second impeller 211. The second rib components 214 are arranged to support the second motor portion 212. The second housing 213 is joined to the first housing 113 along the central axis J1. Joining of the first and second housings 113 and 213 may be accomplished by a variety of methods. For example, the first housing 113 may be provided with a plurality of projecting portions, each of which is arranged to extend toward the second housing 213, and the first and second housings 113 and 213 may be joined to each other through snap fitting using elastic deformation of the projecting portions. Alternatively, the first and second housings 113 and 213 may be joined to each other through fasteners, such as, for example, screws, clips, etc. A tubular wind channel portion 110 is defined as a result of the joining of the first and second housings 113 and 213. The wind channel portion 110 is arranged to surround outer circumferences of the first and second impellers 111 and 211.

The second impeller 211 includes a plurality of second blades 221 and a cup 222. The cup 222 is cylindrical or substantially cylindrical and includes a bottom, and is arranged to cover an outside of the second motor portion 212. The second blades 221 are arranged to extend radially outward from an outside surface of the cup 222, and are arranged in the circumferential direction. The second blades 221 may be arranged either at regular intervals or at irregular intervals. The second motor portion 212 is preferably arranged to have the same or substantially the same structure as that of the first motor portion 112. The second motor portion 212 preferably includes a second rotating portion 231, which is a rotating body, and a second stationary portion 232, which is a stationary body. The second rotating portion 231 is arranged on a lower side of the second stationary portion 232.

The second rotating portion 231 preferably includes a metallic yoke 241, which is cylindrical or substantially cylindrical and includes a bottom, a substantially cylindrical rotor magnet 242, and a shaft 243. The rotor magnet 242 is fixed to an inside of the yoke 241. The shaft 243 is arranged to project upward from a center of the yoke 241. The second impeller 211 is fixed to the second rotating portion 231 such that the cup 222 covers the yoke 241.

The second stationary portion 232 preferably includes a disk-shaped or substantially disk-shaped base portion 251, a bearing holding portion 252, a stator 253, and a circuit board 254. The bearing holding portion 252 is preferably cylindrical or substantially cylindrical, and is arranged to project downward from a center of the base portion 251. The stator 253 is fitted to an outer circumference of the bearing holding portion 252. The circuit board 254 is arranged on an upper side of the stator 253, and is electrically connected to the stator 253.

The second housing 213, the base portion 251, and the second rib components 214 are preferably defined as one monolithic piece by a resin injection molding process, for example. This results in a reduction in the production costs of the parts. The second housing 213 and the base portion 251 are joined to each other through the second rib components 214.

The stator 253 is arranged radially opposite the rotor magnet 242. A torque centered on the central axis J1 is produced between the stator 253 and the rotor magnet 242. Ball bearings 255 and 256, each of which is a bearing mechanism, are arranged inside a lower portion and an upper portion, respectively, of the bearing holding portion 252. The shaft 243 is inserted in the bearing holding portion 252, and is rotatably supported by the ball bearings 255 and 256.

Figure 2:
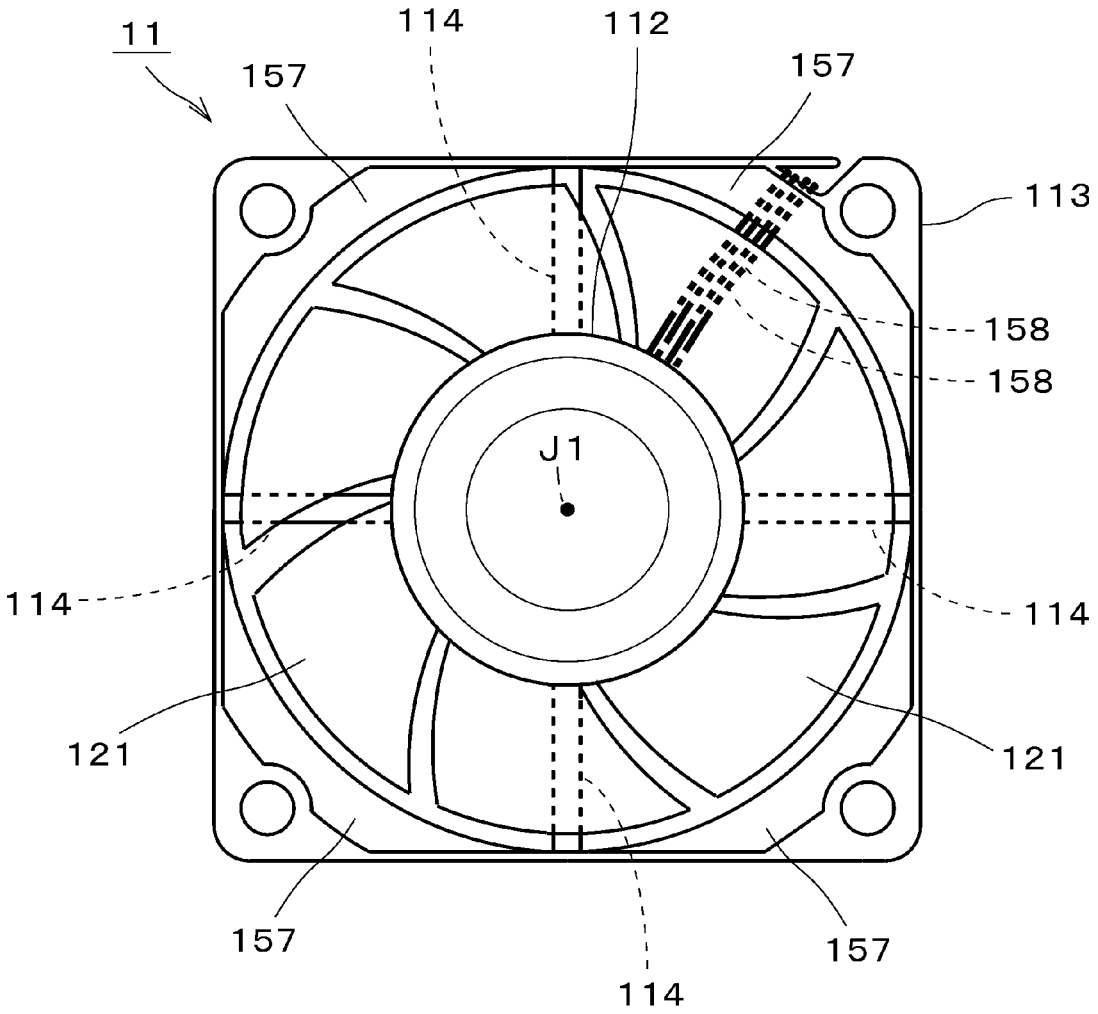
FIG. 2 is a plan view of a first axial fan according to the above preferred embodiment of the present invention.
Figure 3:
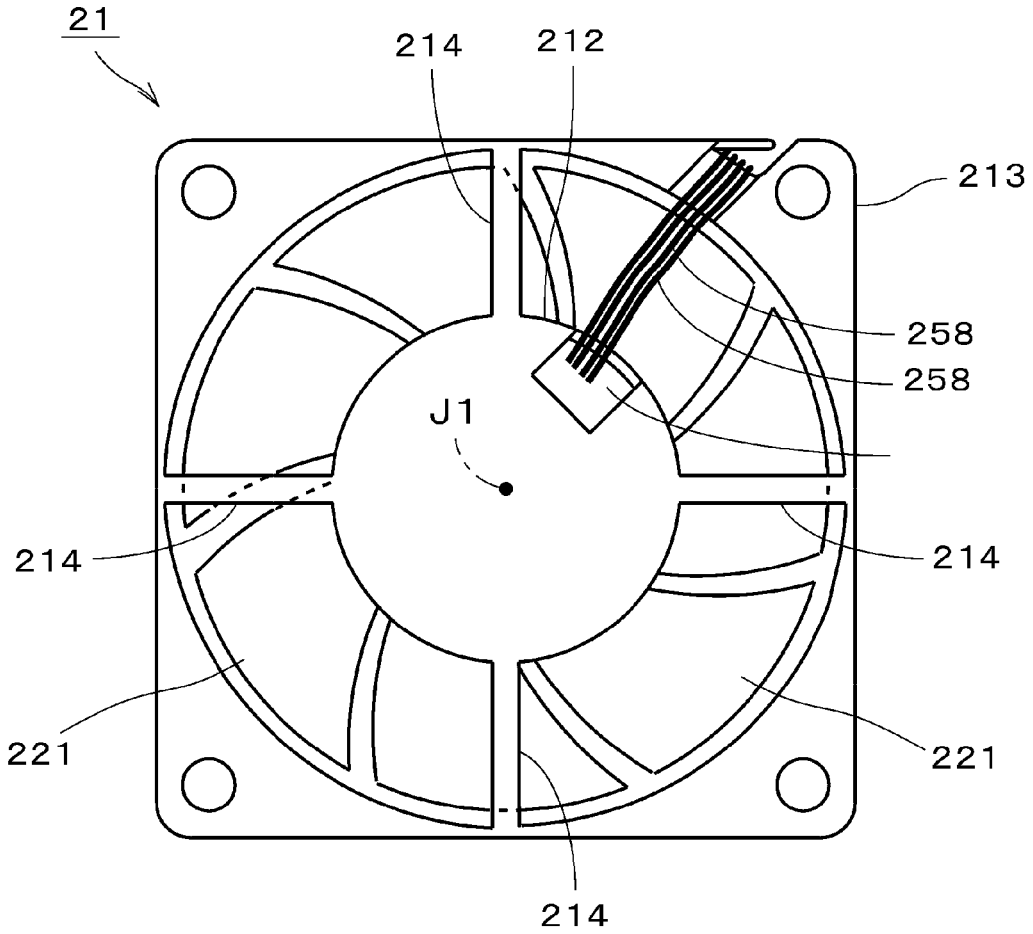
FIG. 3 is a plan view of a second axial fan according to the above preferred embodiment of the present invention.

FIG. 2 is a plan view of the first axial fan 11. FIG. 3 is a plan view of the second axial fan 21. A bottom view of the first axial fan 11 is preferably the same as FIG. 3 except in the shape of the blades. A bottom view of the second axial fan 21 is preferably the same as FIG. 2 except in the shape of the blades. Note that details, such as, for example, portions defining a junction between the first and second housings 113 and 213, may be different. Each of the first and second housings 113 and 213 is arranged to have a square external shape when viewed along the central axis J1. Note that the external shape of each of the first and second housings 113 and 213 may be generally rectangular in shape, and does not need to be perfectly square or rectangular. The wind channel portion 110 as a whole is preferably arranged to have a square or rectangular external shape when viewed along the central axis J1.

The first rib components 114 are arranged in a radial manner. Each first rib component 114 is arranged to extend straight in a radial direction. The second rib components 214 are also arranged in a radial manner. Each second rib component 214 is arranged to extend straight or substantially straight in a radial direction. The number of first rib components 114 and the number of second rib components 214 are preferably equal or substantially equal to each other. As illustrated in FIG. 1, the first rib components 114 and the second rib components 214 are arranged to coincide with each other when viewed in the vertical direction. The first rib components 114 and the second rib components 214 may be arranged to be either in contact with each other or slightly spaced from each other. This contributes to preventing the air currents from being disturbed by the rib components, and also to preventing air currents from being generated between the first rib components 114 and the second rib components 214. In the case where the first rib components 114 and the second rib components 214 are slightly spaced from each other, a reduction in transfer of vibrations between the first and second axial fans 11 and 21 is achieved, and a reduction in interference between the vibrations is achieved.

Each one of the first rib components 114 and a corresponding one of the second rib components 214 are arranged to be in axial contact with or in close axial proximity to each other to together define a single support rib 120. That is, a plurality of support ribs 120 are preferably arranged in a radial manner between the first and second impellers 111 and 211, and each support rib 120 is arranged to extend straight in a radial direction. An extension line of a center line of each support rib 120 passes through the central axis J1. The support ribs 120 are arranged to join the wind channel portion 110 to both the first and second motor portions 112 and 212. The first and second motor portions 112 and 212 are thus supported with respect to the wind channel portion 110.

Referring to FIG. 2, a top portion of an inner surface of each of four corners of the first housing 113, which is square, substantially square, rectangular or substantially rectangular in a plan view, preferably includes an inclined surface 157 arranged to become progressively more distant from the central axis J1 with increasing height. Similarly, a bottom portion of an inner surface of each of four corners of the second housing 213, which is square, substantially square, rectangular or substantially rectangular in a plan view, includes an inclined surface arranged to become progressively more distant from the central axis J1 with decreasing height. In other words, an inner surface of each of four corners of the wind channel portion 110, which is square, substantially square, rectangular or substantially rectangular, includes, at each opening end of the wind channel portion 110, an inclined surface arranged to become progressively more distant from the central axis J1 with decreasing distance from the opening end. An improvement in air-blowing performance, i.e., static pressure-air volume characteristic, of the serial axial fan 1 in both the cases where the serial axial fan 1 sends air downward and where the serial axial fan 1 sends air upward is thus easily achieved. Note that a top portion of an inner surface of the second housing 213 may or may not include an inclined surface. Also note that a bottom portion of an inner surface of the first housing 113 may or may not include an inclined surface.

Referring to FIG. 1, a top portion of the cup 122 of the first impeller 111 of the serial axial fan 1 preferably includes an upwardly convex shape, whereas a bottom portion of the cup 222 of the second impeller 211 of the serial axial fan 1 includes a downwardly convex shape. This also contributes to an easy improvement in the air-blowing performance in both the cases.

Four conducting wires 158, for example, are preferably drawn out of the first motor portion 112. Similarly, four conducting wires 258, for example, are preferably drawn out of the second motor portion 212. Two of the four conducting wires are preferably power lines. Another one of the four conducting wires is preferably used to output a signal corresponding to a rotation speed of the motor portion to an outside. The remaining one of the four conducting wires is preferably used to input a signal which controls the rotation speed from the outside into the motor portion. A PWM (Pulse Width Modulation) signal is preferably used as the signal which controls the rotation speed. A rotation direction of the rotating portion is different depending on whether a pulse width of the signal is below a predetermined value or exceeds the predetermined value. A drive circuit arranged to change the rotation direction and the rotation speed in accordance with the pulse width is preferably arranged on each of the circuit boards 154 and 254.

Figure 4:
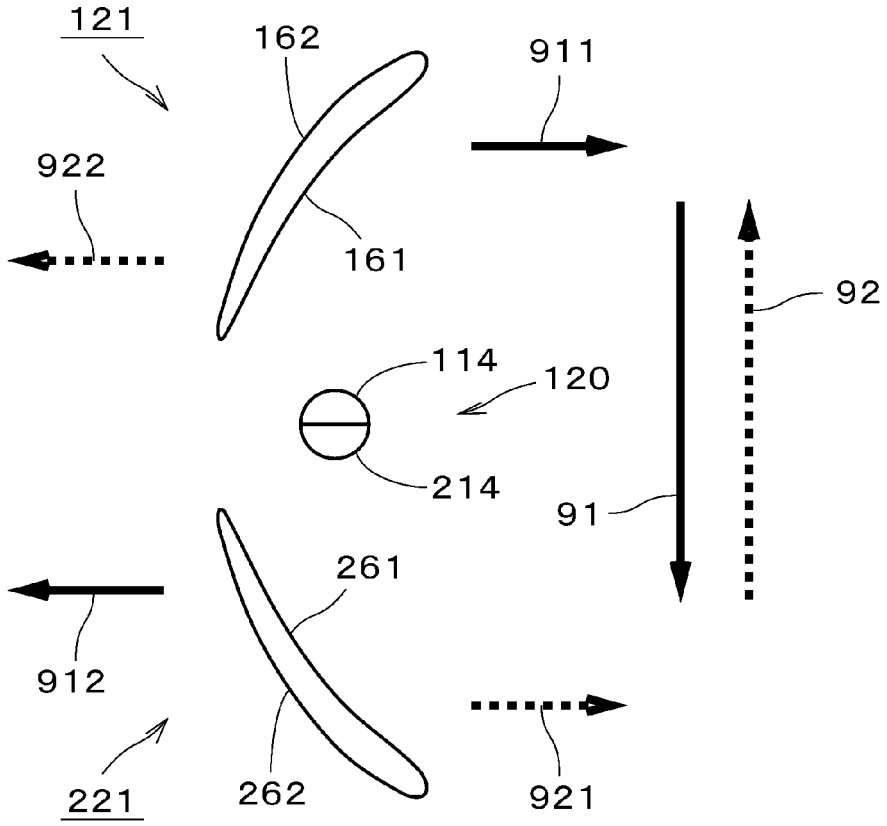
FIG. 4 is a cross-sectional view of a first blade, a second blade, and a support rib according to the above preferred embodiment of the present invention.

FIG. 4 is a diagram illustrating sections of the first blade 121, the second blade 221, and the support rib 120 taken on a cylindrical plane centered on the central axis J1 as developed on a plane. A surface 161 of each of the first blades 121, the surface 161 facing the second impeller 211, is preferably concave. Similarly, a surface 261 of each of the second blades 221, the surface 261 facing the first impeller 111, is preferably concave. The above-described shapes of the blades make it possible to easily obtain excellent static pressure characteristics in both the cases where the serial axial fan 1 sends the air downward and where the serial axial fan 1 sends the air upward. In addition, the serial axial fan 1 is preferably of a counter-rotating type, and this allows a whirl component of the air sent from the fan on an upstream side to be cancelled by the fan on a downstream side to accomplish flow control, such that an excellent static pressure characteristic is obtained.

The surface 161 only needs to be concave as a whole, and the entire surface 161 does not need to be concave in an exact sense. The same is true of the surface 261. A surface 162 of each first blade 121 opposite to the surface 161 is preferably convex. A surface 262 of each second blade 221 opposite to the surface 261 is also preferably convex. Each of the surfaces 162 and 262 only needs to be convex as a whole, and each of the entire surfaces 162 and 262 does not need to be convex in an exact sense.

The sections of the blades whose shapes have been explained above are sections of the blades taken at radially outer positions. The radial positions of the sections do not need to be limited to any particular positions in principle. The above-described shapes may not necessarily be applied to the shapes of sections of the blades taken at bases of the blades or the like. For example, the base of each blade may be in the shape of a flat plate, or may be curved in a direction opposite to that in which another portion of the blade is curved.

In the case where the air is sent downward as indicated by arrow 91, the first blade 121 moves from the left to the right and the second blade 221 moves from the right to the left as indicated by arrows 911 and 912, respectively. In the case where the air is sent upward as indicated by arrow 92, the first blade 121 moves from the right to the left and the second blade 221 moves from the left to the right as indicated by arrows 922 and 921, respectively. The number of first blades 121 and the number of second blades 221 are preferably equal to each other. This makes it easier to make air-blowing performance in the case where the serial axial fan 1 sends the air downward and air-blowing performance in the case where the serial axial fan 1 sends the air upward close to each other. Moreover, the axial dimension of each of the first blades 121, that is, a distance between an upper end and a lower end of each first blade 121, is preferably arranged to be equal to the axial dimension of each of the second blades 221. This also makes it easier to make the air-blowing performance in the case where the serial axial fan 1 sends the air downward and the air-blowing performance in the case where the serial axial fan 1 sends the air upward close to each other. Preferably, the first and second impellers 111 and 211 are arranged to be symmetric with respect to a plane which is perpendicular or substantially perpendicular to the central axis J1 and which divides a space between the first and second motor portions 112 and 212 into two equal or substantially equal portions.

As illustrated schematically in FIG. 1, an edge 163 of each of the first blades 121 on an opposite side with respect to the second impeller 211 preferably includes an inclined portion 164 arranged to become progressively more distant from the second impeller 211 with increasing distance from the central axis J1. Note that the entire edge 163 may be the inclined portion 164 if so desired. The inclined portion 164 is preferably arranged at least in a base portion of each first blade 121. Similarly, an edge 263 of each of the second blades 221 on an opposite side with respect to the first impeller 111 includes an inclined portion 264 arranged to become progressively more distant from the first impeller 111 with increasing distance from the central axis J1. Note that the entire edge 263 may be the inclined portion 264. The inclined portion 264 is preferably arranged at least in a base portion of each second blade 221. An improvement in air blowing efficiency of the fan on an inlet side is thereby achieved, so that an improvement in air blowing efficiency of the entire serial axial fan 1 is easily achieved.

Regarding the preferred embodiment illustrated in FIGS. 2 and 3, in the case where the first axial fan 11 is located on the inlet side in the serial axial fan 1, the first impeller 111 is arranged to rotate in a counterclockwise direction when viewed from above, and each first blade 121 is warped forward with respect to the rotation direction. That is, a straight line that joins the central axis J1 and a radially outer end of a leading edge of each first blade 121 is located forward, with respect to the rotation direction, of a straight line that joins the central axis J1 and a radially inner end of the leading edge of the first blade 121. Meanwhile, the second impeller 211 is arranged to rotate in a clockwise direction when viewed from above, and each second blade 221 is warped backward with respect to the rotation direction. That is, a straight line that joins the central axis J1 and a radially outer end of a leading edge of each second blade 221 is located rearward, with respect to the rotation direction, of a straight line that joins the central axis J1 and a radially inner end of the leading edge of the second blade 221. In the case where the second axial fan 21 is located on the inlet side in the serial axial fan 1, the second impeller 211 is arranged to rotate in the clockwise direction when viewed from below, and each second blade 221 is warped forward with respect to the rotation direction. The first impeller 111 is arranged to rotate in the counterclockwise direction when viewed from below, and each first blade 121 is warped backward with respect to the rotation direction.

Whether each blade is warped forward or backward with respect to the rotation direction is determined appropriately in accordance with a desired air-blowing performance. Note, however, that the direction in which each first blade 121 is warped with respect to the rotation direction of the first impeller 111 is arranged to be opposite to the direction in which each second blade 221 is warped with respect to the rotation direction of the second impeller 211, i.e., the rotation direction opposite to the rotation direction of the first impeller 111. In other words, each first blade 121 and each second blade 221 are preferably arranged to be warped in the same direction when viewed from above.

In still other words, the leading edge of each of the first blades 121 with respect to the rotation direction of the first impeller 111 and a trailing edge of each of the second blades 221 with respect to the rotation direction of the second impeller 211 are located on the same side of the blades in a plan view, and the leading edge of the first blade 121 and the trailing edge of the second blade 221 are warped in different directions with respect to the rotation directions of the first and second impellers 111 and 211, respectively. This makes it easy to make the air-blowing performance in the case where the serial axial fan 1 sends the air downward and the air-blowing performance in the case where the serial axial fan 1 sends the air upward close to each other.

The leading edge and the trailing edge of each of the first and second blades 121 and 221 may be arranged to be warped in both circumferential directions with increasing distance from the central axis J1. In this case, the leading edge is arranged to be warped forward with respect to the rotation direction, while the trailing edge is arranged to be warped backward with respect to the rotation direction. That is, each of the first and second blades 121 and 221 may be fan-shaped in a plan view. Conversely, in a plan view, the leading edge and the trailing edge of each of the first and second blades 121 and 221 may be arranged to be warped backward and forward, respectively, with respect to the rotation direction with increasing distance from the central axis J1. In this case, each blade tapers toward a tip.

Figure 5:
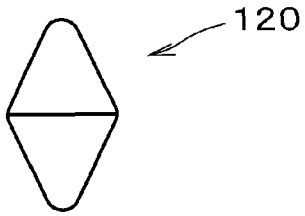
FIG. 5 is a diagram illustrating a section of a support rib according to a modification of the above preferred embodiment of the present invention.
Figure 6:
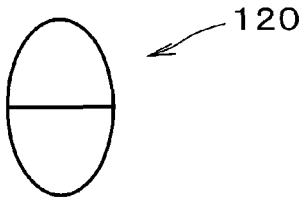
FIG. 6 is a diagram illustrating a section of a support rib according to another modification of the above preferred embodiment of the present invention.

In FIG. 4, a section of the support rib 120 is preferably circular or substantially circular. Here, the "section" refers to a section of each support rib 120 taken on a plane perpendicular to a direction of extension of the support rib 120. The width of the section of each support rib 120 measured in a direction perpendicular to the central axis J1 may change in a variety of manners so long as the width is arranged to gradually increase in a direction away from the first impeller 111 toward the second impeller 211 and then gradually decrease. Preferably, a section of the first rib component 114 is arranged to gradually increase in the direction away from the first impeller 111 toward the second impeller 211, while a section of the second rib component 214 is arranged to gradually decrease in the direction away from the first impeller 111 toward the second impeller 211. For example, the section of the support rib 120 may be in the shape of a rhombus with chamfered corners as illustrated in FIG. 5, or may be in the shape of an ellipse as illustrated in FIG. 6.

Moreover, in order to make the air-blowing performance in the case where the serial axial fan 1 sends the air downward and the air-blowing performance in the case where the serial axial fan 1 sends the air upward close to each other, it is preferable that the overall shape of the support ribs 120 as viewed from the direction of the first impeller 111 along the central axis J1 should be identical to the overall shape of the support ribs 120 as viewed from the direction of the second impeller 211 along the central axis J1. Here, the term "overall shape" comprehends the arrangement of the support ribs 120 and the three-dimensional shape of each support rib 120.

Figure 7:
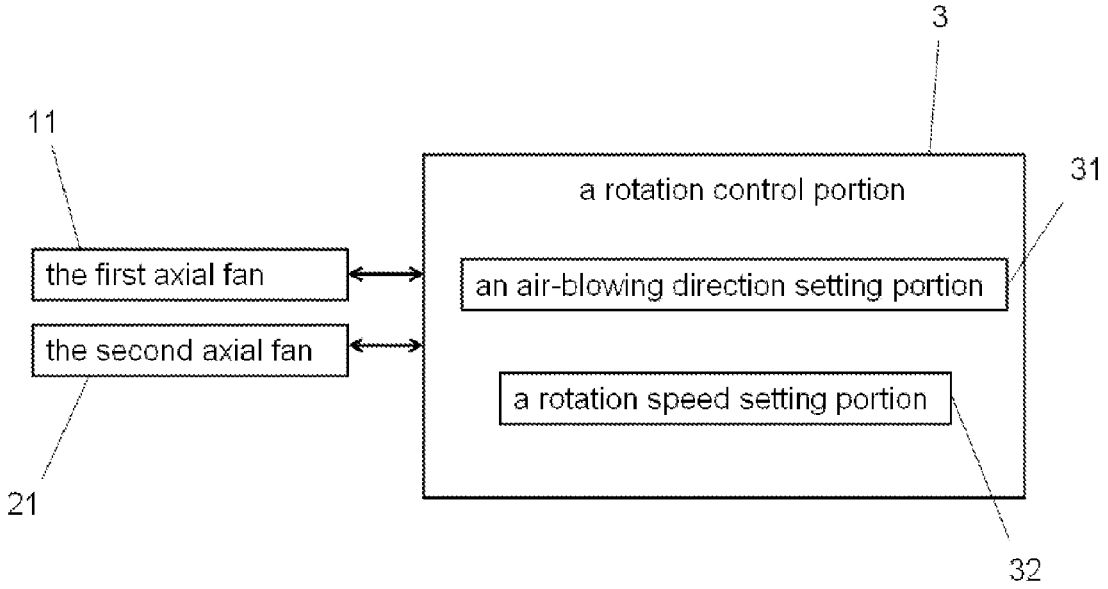
FIG. 7 is a diagram illustrating the serial axial fan and a rotation control portion according to the above preferred embodiment of the present invention.

FIG. 7 is a diagram illustrating a rotation control portion 3 electrically connected to the serial axial fan 1. The signal which controls the rotation speed is inputted from the rotation control portion 3 to each of the first and second axial fans 11 and 12. The signal which controls the rotation speed will be hereinafter referred to as a "rotation control signal". As mentioned above, the rotation control signal is preferably a PWM signal, and serves also to indicate the rotation direction. To be precise, a rotation control signal of the first axial fan 11 is inputted to the drive circuit on the circuit board 154 of the first motor portion 112. A sensor arranged to detect the rotation speed is arranged on the circuit board 154, and a signal that indicates the rotation speed is inputted from the first axial fan 11 to the rotation control portion 3. The rotation control portion 3 refers to the signal sent from the sensor to adjust the pulse width of the rotation control signal. A rotation control signal of the second axial fan 12 is also adjusted in a similar manner.

The rotation control portion 3 preferably includes air-blowing direction setting portion 31 and a rotation speed setting portion 32. The air-blowing direction setting portion 31 is arranged to set air-blowing direction of the serial axial fan 1 in accordance with an input from an outside. Note that, in the case where the air-blowing direction is previously set to only one direction in the device on which the serial axial fan 1 is installed, the air-blowing direction setting portion 31 may be omitted.

The rotation speed setting portion 32 is arranged to set rotation speeds of the first and second axial fans 11 and 12 individually. Only one value, e.g., a proportion to a maximum rotation speed, is inputted from the device into the rotation speed setting portion 32. Based on this value, the rotation speed of the axial fan on the inlet side and the rotation speed of the axial fan on an outlet side are set by the rotation speed setting portion 32.

Here, in the serial axial fan 1, the rotation speed of one of the first and second impellers 111 and 211 which is located on the inlet side, i.e., on the upstream side, is preferably set higher than the rotation speed of the other impeller 111 or 211 located on the outlet side, i.e., on the downstream side, by the rotation speed setting portion 32. Suppose, for example, that a maximum rotation speed of the axial fan on the inlet side and a maximum rotation speed of the axial fan on the outlet side are previously set to 10,000 $min^{-1}$ (revolutions/minute) and 7,000 $min^{-1}$, respectively, and that a signal that indicates 50% rotation is inputted from the device into the rotation control portion 3. In this case, the rotation speed setting portion 32 inputs a rotation control signal that indicates rotation at 5,000 $min^{-1}$ to the axial fan on the inlet side and a rotation control signal that indicates rotation at 3,500 $min^{-1}$ to the axial fan on the outlet side.

In the serial axial fan 1, the surface of each of the blades of the impeller on the inlet side, the surface facing the impeller on the outlet side, is concave, and therefore, the axial fan on the inlet side exhibits higher air blowing efficiency than the axial fan on the outlet side. Therefore, an improvement in the air blowing efficiency of the serial axial fan 1 as a whole is easily achieved by arranging the rotation speed of the axial fan on the inlet side to be higher than the rotation speed of the axial fan on the outlet side. Moreover, the different rotation speeds of the two axial fans result in a difference in fundamental frequency of noises caused by the respective fans, such that desirable frequency characteristics of the noises are obtained.

Note that the rotation control portion 3 may be a portion of the serial axial fan 1. Furthermore, the rotation control portion 3 may be arranged on each of the circuit boards 154 and 254 of the serial axial fan 1 individually. In this case, the signal is inputted from the device into each of the first and second axial fans 11 and 21, and the rotation control portion arranged in each axial fan generates the rotation control signal in accordance with this signal, for example.

Figure 8:
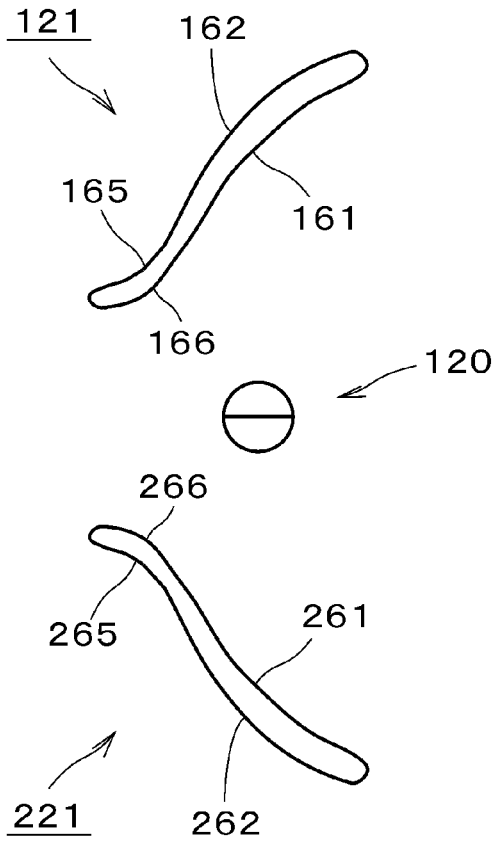
FIG. 8 is a cross-sectional view of a first blade and a second blade according to a modification of the above preferred embodiment of the present invention.

FIG. 8 is a cross-sectional view of a first blade 121 and a second blade 221 according to a modification of the above-described preferred embodiment, and the same method of depiction as that of FIG. 4 is adopted in FIG. 8. As with the preferred embodiment illustrated in FIG. 4, a surface 161 of each first blade 121 which faces a second impeller 211 can be considered to be concave as a whole. A surface 261 of each second blade 221 which faces a first impeller 111 can also be considered to be concave as a whole. A surface 162 of each first blade 121 opposite to the surface 161 can be considered to be convex as a whole. The surface 162 is a surface of the first blade 121 on an opposite side with respect to the second impeller 211. A surface 262 of each second blade 221 opposite to the surface 261 can also be considered to be convex as a whole. The surface 262 is a surface of the second blade 221 on an opposite side with respect to the first impeller 111.

Note, however, that a small region 165 defining a portion of the surface 162 is concave. The region 165 is preferably a region in the surface 162 which is located forward with respect to a rotation direction of the first impeller 111 when the first impeller 111 sends air out of an wind channel portion 110, that is, when a first axial fan 11 is a fan on an outlet side. Similarly, a small region 265 defining a portion of the surface 262 is concave. The region 265 is preferably a region in the surface 262 which is located forward with respect to a rotation direction of the second impeller 211 when the second impeller 211 sends air out of the wind channel portion 110, that is, when a second axial fan 21 is the fan on the outlet side. This contributes to reducing or preventing a decrease in air blowing efficiency of a serial axial fan 1 as a whole owing to the fan on the outlet side. A region 166 on the first blade 121 on an opposite side with respect to the region 165 is convex. A region 266 on the second blade 221 on an opposite side with respect to the region 265 is convex.

The present invention is not limited to the serial axial fan 1 according to the above-described preferred embodiments and modifications thereof. A variety of additional modifications are also possible within the scope of the present invention.

Concavity and convexity of each of the upper and lower surfaces of each blade as a whole in a cross-section can be defined in a variety of manners. A variety of methods of definition can be adopted as long as the methods are usable to indicate an approximate state of bending of the surface as a whole. For example, a straight line that joins both circumferential end points of the blade in the cross-section may be defined as a chord, and a surface equidistant from the upper and lower surfaces of the blade may be defined as a middle surface of the blade. Then, each of the upper and lower surfaces of the blade may be defined as being convex or concave to a side of the chord on which more than half an entire region of the middle surface exists. Also note that, as mentioned above, the blade may be concave at one radial position and convex at another radial position in the cross-section.

Note that the air-blowing performance in the case where the serial axial fan 1 sends the air downward and the air-blowing performance in the case where the serial axial fan 1 sends the air upward may be different from each other as long as specifications of the serial axial fan 1 are met. Therefore, the number of first blades 121 and the number of second blades 221 may be different from each other.

In the above-described preferred embodiments and modifications thereof, the rotation speed of the impeller on the inlet side is configured to be higher than the rotation speed of the impeller on the outlet side. Note, however, that rotation control according to preferred embodiments of the present invention is not limited to the rotation control as described above. For example, the rotation speeds of both the impellers may be configured to be equal or substantially equal to each other. Furthermore, the rotation speed of the impeller on the inlet side may be arranged to be lower than the rotation speed of the impeller on the outlet side.

Note that each support rib 120 may not necessarily be straight. Because the first and second impellers 111 and 211 are preferably arranged to be symmetric or substantially symmetric with respect to a plane perpendicular or substantially perpendicular to the central axis J1, each support rib 120 can be curved without significantly affecting a difference between the air-blowing performance in the case where the serial axial fan 1 sends the air downward and the air-blowing performance in the case where the serial axial fan 1 sends the air upward. Also note that the support ribs 120 may not necessarily be arranged at regular intervals in the circumferential direction. Also note that each support rib 120 may be defined as one unitary body without the first and second rib components 114 and 214.

Also note that the first and second rib components 114 and 214 may not necessarily be located between the first and second motor portions 112 and 212. For example, it may be so arranged that the first rotating portion 131, the first stationary portion 132, the second rotating portion 231, and the second stationary portion 232 are arranged in the order named along the central axis J1, and the first impeller 111, the first rib components 114, the second impeller 211, and the second rib components 214 are arranged in the order named. In this case, each of the first and second rib components 114 and 214 functions as the support rib. Needless to say, the first rib components 114, the first impeller 111, the second impeller 211, and the second rib components 214 may be arranged in the order named.

Also note that each support rib 120 may be arranged to extend in a direction inclined with respect to a plane perpendicular to the central axis J1.

Also note that the wind channel portion 110 may be arranged to have a circular or substantially circular external shape. Also note that the wind channel portion 110 may be defined as one unitary body, for example.

It may be so arranged that the yoke is cylindrical and the shaft is joined to a center of the cup. Alternatively, it may be so arranged that the cup is molded in a cylindrical shape, and is fixed to an outer circumferential surface of the yoke which is in or substantially in the shape of a covered cylinder.

Also note that a fluid which is caused to flow by the serial axial fan 1 is not limited to the air. The fluid may be a different type of gas or a liquid.

Features of the above-described preferred embodiments and the modifications thereof may be combined appropriately as long as no conflict arises.

Various preferred embodiments of the present invention are applicable to a variety of axial fans arranged to cause a fluid to flow. A serial axial fan according to a preferred embodiment of the present invention is preferably used, for example, as a fan to cool an electronic device or the like.

While preferred embodiments of the present invention have been described above, it is to be understood that variations and modifications will be apparent to those skilled in the art without departing from the scope and spirit of the present invention. The scope of the present invention, therefore, is to be determined solely by the following claims.

What is claimed is:

1. A serial axial fan comprising:

a first motor portion including a first rotating portion;

a first impeller fixed to the first rotating portion of the first motor portion;

a second motor portion arranged along a central axis of the first motor portion, and including a second rotating portion;

a second impeller fixed to the second rotating portion of the second motor portion;

a tubular wind channel portion arranged to surround outer circumferences of the first and second impellers; and a plurality of support ribs arranged to join the wind channel portion to both the first and second motor portions; wherein the first impeller includes a plurality of first blades arranged in a circumferential direction about the central axis, and the second impeller includes a plurality of second blades arranged in the circumferential direction;

each of the first and second impellers is configured to be rotatable in both directions, and a rotation direction of the second impeller is always opposite to a rotation direction of the first impeller;

a portion of a surface of each of the plurality of first blades, the surface facing the second impeller, is concave, and a portion of a surface of each of the plurality of second blades, the surface facing the first impeller, is concave;

the plurality of support ribs are located between the first and second impellers;

an edge of each of the plurality of first blades on an opposite side with respect to the second impeller includes an inclined portion configured to become progressively more distant from the second impeller with increasing distance from the central axis; and an edge of each of the plurality of the second blades on an opposite side with respect to the first impeller includes an inclined portion configured to become progressively more distant from the first impeller with increasing distance from the central axis.

2. The serial axial fan according to claim 1, wherein a rotation speed of one of the first and second impellers which is located on an upstream side is higher than a rotation speed of the other of the first and second impellers located on a downstream side.

3. The serial axial fan according to claim 1, wherein the plurality of first blades and the plurality of second blades are equal in number.

4. The serial axial fan according to claim 1, wherein the wind channel portion has a square or rectangular external shape when viewed along the central axis; and an inner surface of each of four corners of the wind channel portion includes, at each of both opening ends of the wind channel portion, an inclined surface configured to become progressively more distant from the central axis with decreasing distance from the opening end.

5. The serial axial fan according to claim 1, wherein a width of a section of each of the plurality of support ribs taken on a plane perpendicular to a direction of extension of the support rib, the width being measured in a direction perpendicular to the central axis, is configured to first gradually increase in a direction away from the first impeller toward the second impeller and then gradually decrease; and a shape of the plurality of support ribs as viewed from a direction of the first impeller along the central axis is configured to be identical to a shape of the plurality of support ribs as viewed from a direction of the second impeller along the central axis.

6. The serial axial fan according to claim 5, wherein each of the plurality of support ribs extends straight in a radial direction.

7. The serial axial fan according to claim 1, wherein a leading edge of each of the plurality of first blades with respect to the rotation direction of the first impeller and a trailing edge of each of the plurality of second blades with respect to the rotation direction of the second impeller are warped in different directions with respect to the rotation directions of the first and second impellers, respectively.

8. The serial axial fan according to claim 1, wherein each of the plurality of first blades has an axial dimension equal to that of each of the plurality of second blades.

9. The serial axial fan according to claim 1, wherein a region in a surface of each of the plurality of first blades on an opposite side with respect to the second impeller, the region being located forward with respect to the rotation direction of the first impeller when the first impeller is configured to send a fluid out of the wind channel portion, is concave; and a region in a surface of each of the plurality of second blades on an opposite side with respect to the first impeller, the region being located forward with respect to the rotation direction of the second impeller when the second impeller is configured to send the fluid out of the wind channel portion, is concave.

* * * * *